US009034147B2

(12) United States Patent
Kim et al.

(10) Patent No.: US 9,034,147 B2
(45) Date of Patent: May 19, 2015

(54) METHOD TO REDUCE HEAT RADIATION LOSSES THROUGH COKE OVEN CHAMBER DOORS AND WALLS BY ADAPTING THE COAL CAKE IN HEIGHT OR DENSITY

(75) Inventors: Ronald Kim, Essen (DE); Rainer Worberg, Bottrop (DE)

(73) Assignee: THYSSENKRUPP UHDE GMBH, Dortmund (DE)

( * ) Notice: Subject to any disclaimer, the term of this patent is extended or adjusted under 35 U.S.C. 154(b) by 882 days.

(21) Appl. No.: 13/138,782

(22) PCT Filed: Mar. 11, 2010

(86) PCT No.: PCT/EP2010/001517
§ 371 (c)(1), (2), (4) Date: Nov. 9, 2011

(87) PCT Pub. No.: WO2010/112128
PCT Pub. Date: Oct. 7, 2010

(65) Prior Publication Data

US 2012/0055774 A1 Mar. 8, 2012

(30) Foreign Application Priority Data

Apr. 1, 2009 (DE) ..... 10 2009 015 240

(51) Int. Cl.

| | |
|---|---|
| ***C10B 53/00*** | (2006.01) |
| ***C10B 31/10*** | (2006.01) |
| ***C10B 25/24*** | (2006.01) |
| ***C10B 25/16*** | (2006.01) |

(Continued)

(52) U.S. Cl.
CPC ..... *C10B 31/10* (2013.01); *C10B 25/24* (2013.01); *C10B 25/16* (2013.01); *C10B 25/00* (2013.01); *C10B 45/00* (2013.01); *C10B 45/02* (2013.01)

(58) Field of Classification Search
CPC ..... C10B 13/00; C10B 25/00; C10B 25/08; C10B 25/16; C10B 25/24; C10B 31/00; C10B 45/00
USPC ..... 201/6, 8, 24, 40; 264/120; 44/591, 596, 44/620, 626; 202/242, 245, 269
See application file for complete search history.

(56) References Cited

U.S. PATENT DOCUMENTS 4,318,779 A * 3/1982 Tsuyuguchi et al. ..... 201/6
4,385,962 A * 5/1983 Stewen et al. ..... 201/6

(Continued)

FOREIGN PATENT DOCUMENTS

| | | | |
|---|---|---|---|
| DE | 549 029 | C | 4/1932 |
| DE | 195 45 736 | A1 | 6/1997 |
| WO | WO 2006/056286 | A1 | 6/2006 |

*Primary Examiner* — Nina Bhat
(74) *Attorney, Agent, or Firm* — Marshall & Melhorn, LLC

(57) ABSTRACT

A method for reducing the coking time in the oven area near the door or end wall and for improving coke quality and situation of emissions by compensating for radiation losses through coke oven chamber doors and end walls is described. This compensation is accomplished by varying the height of the coal cake in the environment of the frontal coke oven chamber doors. The variation is achieved both by increasing or decreasing the coal cake over part of the length or over the entire length of the coke oven chamber door. The reduction in the height of the coal cake can be generated by omission of coal or coal compacts, the increase in height can be accomplished by stacking of coal and pressing or adding of coal compacts, with it also being envisaged to omit the pressing cycle so as to obtain a recess with a lower coal cake density which also has less heat radiation.

10 Claims, 4 Drawing Sheets

(51) Int. Cl.

| | |
|---|---|
| ***C10B 25/00*** | (2006.01) |
| ***C10B 45/00*** | (2006.01) |
| ***C10B 45/02*** | (2006.01) |

(56) References Cited

U.S. PATENT DOCUMENTS

| | | | | |
|---|---|---|---|---|
| 4,606,876 | A * | 8/1986 | Yoshida et al. | 264/120 |
| 6,059,932 | A * | 5/2000 | Sturgulewski | 202/262 |
| 7,497,930 | B2 * | 3/2009 | Barkdoll et al. | 201/41 |
| 7,815,829 | B2 * | 10/2010 | Schuecker | 264/148 |
| 8,105,516 | B2 * | 1/2012 | Fiedler et al. | 264/120 |
| 8,652,372 | B2 * | 2/2014 | Kim | 264/109 |
| 2006/0231380 | A1 * | 10/2006 | Yamasaki | 202/242 |
| 2007/0289861 | A1 * | 12/2007 | Barkdoll et al. | 201/8 |
| 2012/0030998 | A1 * | 2/2012 | Barkdoll et al. | 44/591 |

* cited by examiner

METHOD TO REDUCE HEAT RADIATION LOSSES THROUGH COKE OVEN CHAMBER DOORS AND WALLS BY ADAPTING THE COAL CAKE IN HEIGHT OR DENSITY

BACKGROUND OF THE INVENTION

The invention relates to a method for compensation of radiation losses due to heat radiation on operation of coke oven chambers, said radiation relating to a loss of heat through coke oven chamber doors which usually occurs through coke oven chamber doors or end walls of coke oven chambers, and wherein the compensation of radiation losses is accomplished by way of a special shaping of the coal cake which leads to a reduced loss of heat needed for coal carbonization in the oven area near the door and end wall, thus increasing coke quality in these areas and shortening the time for complete carbonization of a coal charge. Likewise the present invention improves the situation of emissions on discharging the coke batch. Shaping of the coal cake is generated during compaction of the coal cake which is produced by pressing the coal to obtain a coal cake. Shaping may be understood to be a recess through which part of the coal cake is left empty or an elevation in which a heightened amount of coal is shed onto the coal cake and pressed.

Compaction of coal to load coke oven chambers is actually known from prior art in technology. The production of pressed coal cakes by applying suitable devices is described in WO 2006/056286 A1. Applying the method described in this teaching, a coal cake is moulded in a press mould by means of stationary pressing tools which work horizontally and with a limited stroke length. The press mould comprises a slidable stop wall which is moved away by the pressing tools under the impact of suitable braking force acting in the opposite direction as the coal cake grows. By way of this method, the coal cake is compacted before it is introduced into a coal transport car or a coke oven chamber.

The loading and/or charging of coke oven chambers is then accomplished by applying methods known from prior art in technology. A customary design type for charging horizontal coke oven chambers is described in DE 19545736 A1. Coal is shed outside the oven at an even level onto a planar bottom plate and subsequently compacted, whereupon the compacted coal cake together with the bottom plate is gently pushed into the coke oven chamber, retracting the bottom plate subsequently from the oven chamber whilst the coal cake is retained at the front side. By way of these methods, it is possible to charge horizontal coke oven chambers, in particular, which are equipped with a floor heating.

By way of this method, a compacted coal cake having a regular shape is introduced into a coke oven chamber. It is especially at doors of coke oven chambers with low insulation where the coal cake leans tightly to so that substantial loss of heat occurs due to radiation through the doors, with the consequence that this area of a coal charge in most cases leaves the oven in incompletely carbonized status, thus taking an adverse effect on the situation of emissions during the process of emptying a coke oven. This entails inferior quality of the coke, particularly in the area of coke oven chamber doors. For this reason, possibilities are searched to compensate for radiation losses through coke oven chamber doors and to improve the status of completeness of coal carbonization.

Now, therefore, it is an object of the present invention to compensate radiation losses from coke oven chambers in the area near the coke oven chamber door and near the end walls, thereby improving the status of completeness of coal charge carbonization, with it being intended to achieve this reduction by way of a special shaping of the coal cake. The shaping should include for an increase or decrease in the height of the coal cake, with this increase or decrease in the height of the coal cake being implemented over parts of the coal cake that are situated near the coke oven chamber doors.

BRIEF SUMMARY OF THE INVENTION

The present invention solves this task by providing a method that gives the coal cake a special shape whilst compacted which changes the height of the coal cake in charged form near the coke oven chamber doors, this change being accomplished by increasing or decreasing the height of the coal cake. In an embodiment of the method, it is also feasible to fill the recesses thus obtained with a constant coal cake height by a coal cake having a reduced density. In another embodiment of the present invention, it is feasible to furnish the first and last coke oven chamber of one coke oven bank or coke oven battery each with a coal cake having a modified height or density, with the recess of the coal cake lying near the bordering lateral coke oven chamber end walls and thus reducing radiation losses through coke oven chamber end walls.

By altering the coal cake height and density, the coking time of a coal charge in this oven area is shortened so that coke quality is increased and radiation through coke oven chamber walls or doors is substantially reduced.

To produce the recess in producing a compacted coal cake, one compact is simply omitted. In the same way, a partial increase in height of the coal cake can be achieved by adding one coal compact at the desired position. This mode of production is feasible if the coal cake is produced by compaction and cutting it apart into individual compacts. Depending on the size of compacts, even several compacts can be utilized for producing the increase in height or the recess. In case the coal is produced by simple pressing, the recess can be produced by filling a reduced quantity of coal into a compacting mould and pressing it. In the same way, a corresponding elevation is generated by adding a corresponding amount of coal, filling it up with suitable laterally shaping elements and pressing it down. Examples for suitable laterally shaping elements are metal sheets. Moreover, this recess can be generated in the way that the filled-in amount of coal at the lateral ends of the compacted coal cake is not compacted at all but rests as a loose bulk on the coal compact lying underneath.

The present invention defines a method for reduction of the coking time of a coal charge in the area near a coke oven door and for compensation of heat radiation losses through coke oven chamber doors by adapting the coal cake in height or density, wherein

- a heap of coal is pressed by applying a compacting method to obtain a compacted coal cake having a density ranging from 700 to 1300 kg/m$^3$, and
- the compacted coal cake is charged through the charging opening of a coke oven chamber into the coke oven chamber and which is characterized in that

- a recess or elevation of the coal cake is generated during coal compaction at the upper coal cake sides facing the coke oven chamber doors, said recess or elevation not filled with coal or filled with less coal.

Basically only one recess is required. For some purposes, however, it is also possible to implement an elevation of the coal cake, optionally even in combination with a recess. The height of said recess or elevation may vary, but to achieve the inventive effect is preferably ranges from 20 to 700 mm. Typical heights of a compacted coal cake amount to 700 to 1300 mm. The depth of said recess or elevation of the coal cake may also vary, but preferably it amounts to 0.25 to 5 meters. The width of the elevation or recess of the coal cake along a coke oven door may vary arbitrarily.

In its pressed form, the density of a coal cake usually ranges from 700 to 1,300 kg/m$^3$. If a recess is generated by reducing the density of a coal cake, the density is expediently decreased by 20 to 300 kg/m$^3$ This decrease in density, for example, can be accomplished by leaving one recess empty, refilling the recess left empty with coal in top charging mode so that the recess has a reduced coal cake density. Provision of a recess having a reduced density can be combined with a normal elevation or recess of the coal cake as described hereinabove.

By providing a recess in the coal cake height accounting for 2 meters in depth, assuming a width of the recess accounting for 1 meter and a door width of approx. 4 meters, the coking time in this coal cake area reduces by approx. 4 of 60 hours per 100 mm height of the recess. By providing a recess in the coal cake height by means of a reduced density accounting for 2 meters in depth, assuming a width of the recess accounting for 1 meter and a door width of approx. 4 meters, the coking time in this coal cake area reduces by approx. 5 of 60 hours per 100 kg/m$^3$ reduced density per 100 mm height of the recess.

To execute the inventive method for producing a coal cake with a recess or elevation, any arbitrarily chosen methods may eventually be applied, if an elevation or recess can thereby be produced.

In another embodiment of the present invention, only the coal cakes of the first and last coke oven chamber of a coke oven bank or coke oven battery are provided with an increase or decrease of the coal cake. It is advantageous to provide the coal cake of the first coke oven chamber (first end oven) of a coke oven battery or a coke oven bank with an increase in height of the coal cake, and to provide the coal cake of the last coke oven chamber (second end oven) of a coke oven bank or a coke oven battery with a recess or increase in height. This recess or increase in height is not only implemented at the side of the coal cake facing the door, but also at the lateral end walls of the coke oven chambers of a coke oven battery or coke oven bank.

Additionally defined is a method for reducing the coking time and for compensation of radiation losses through coke oven chamber doors by adapting the coal cake in height or density, which is characterized in that

- the coke oven chamber is part of a coke oven battery or coke oven bank, and the first coke oven chamber of the coke oven battery or coke oven bank is provided with an elevation or recess of the coal cake along the laterally closing coke oven chamber end wall, and
- the last coke oven chamber of the coke oven battery or coke oven bank is provided with a recess of the coal cake along the laterally closing coke oven chamber end wall.

The height of said recess or elevation of the coal cake of the first or last coke oven chamber is preferably set to 20 to 700 mm as done in case of a simple coal cake. The depth of said recess or elevation reaching into the coke oven chamber typically corresponds to the entire length of the lateral coke oven chamber wall, but it may also be less. The width preferably amounts to 25 percent in length of the door length. The number of coke oven chambers per coke oven battery or coke oven bank may be varied arbitrarily.

Even the recess or elevation of the first and last coke oven chamber may be provided by omitting or adding a coal compact. The elevation may be generated by stacking and shaking or placement of one or several additional compacts. Stacking and shaking can be executed by pressing-down and filling-up with lateral shaping elements. In another embodiment of the method, a recess filled with a coal compact or a coal batch having a reduced coal cake density is generated in the coal cake of the first and last coke oven chamber. On application of this method, the recess is typically filled with a coal cake, the density of which is reduced by 20 to 300 kg/m$^3$. The reduced coal cake density, for example, can be generated by omitting, stacking and shaking.

Further defined is the use of a coal cake produced by applying the inventive method and envisaged for being charged into a coke oven chamber for coal carbonization and utilized for coal carbonization in a coke oven chamber. Typical coke oven chambers in which coal carbonization with the inventively produced coal cake is accomplished are coke oven chambers of the "Non-Recovery" or "Heat Recovery" type. Likewise, it is possible to use the inventively produced coal cakes in conventional coke oven chambers.

The described method of providing a recess or elevation in a coal cake to be charged into a coke oven chamber offers the advantage of an improved coke quality in the areas near the coke oven door or end wall because of a reduced coking time whilst simultaneously reducing heat radiation through the doors of coke oven chambers which frequently have a reduced heat insulation. The method also offers the advantage in that the heat radiation through lateral coke oven chamber walls of coke oven chambers is reduced by utilizing the inventively produced coal cake.

BRIEF DESCRIPTION OF THE DRAWINGS

The inventive device is elucidated by way of four drawings, with these drawings just representing exemplary embodiments for the design of the inventive device.

DETAILED DESCRIPTION OF THE INVENTION

Figure 1:
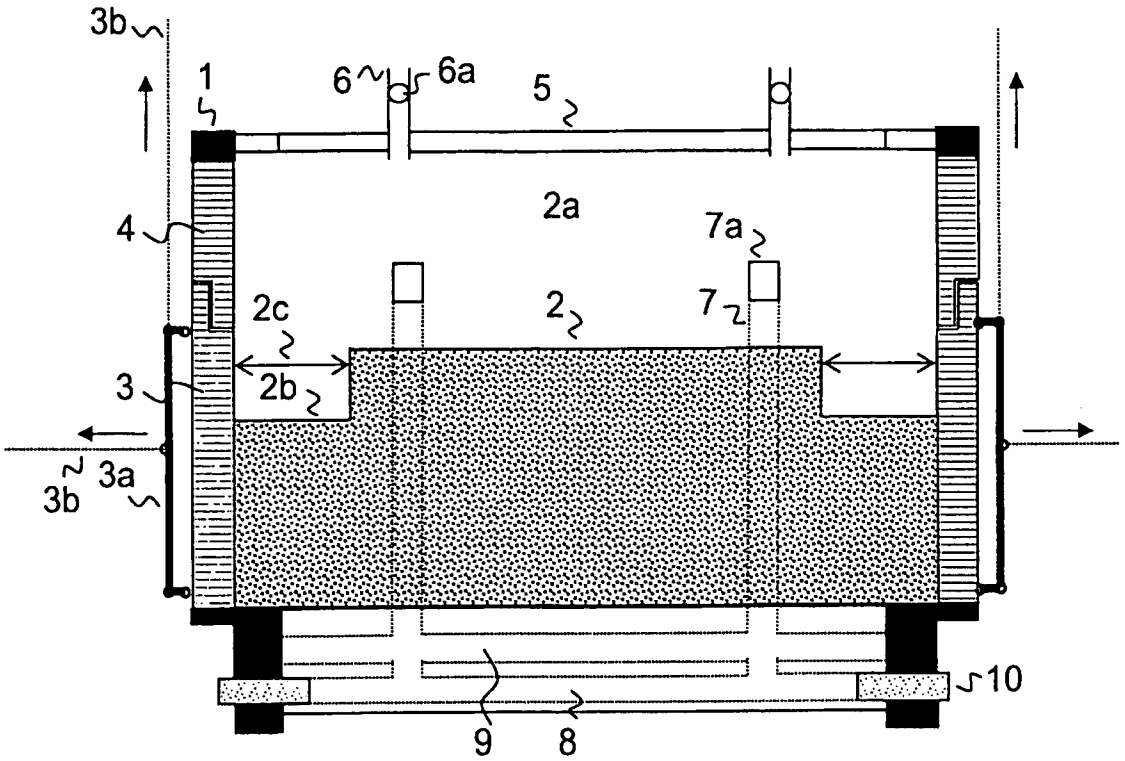
FIG. 1 shows a coke oven chamber according to an embodiment of the present invention.
Figure 2:
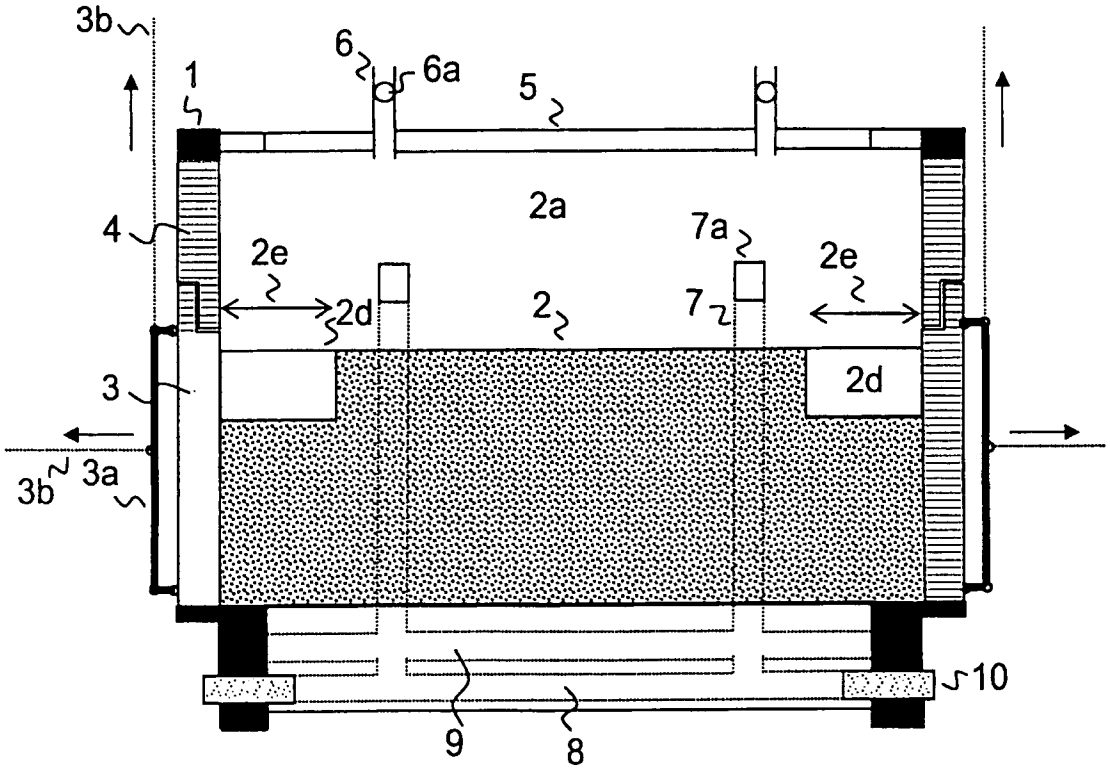
FIG. 2 shows a coke oven chamber according to an embodiment of the present invention.
Figure 3:
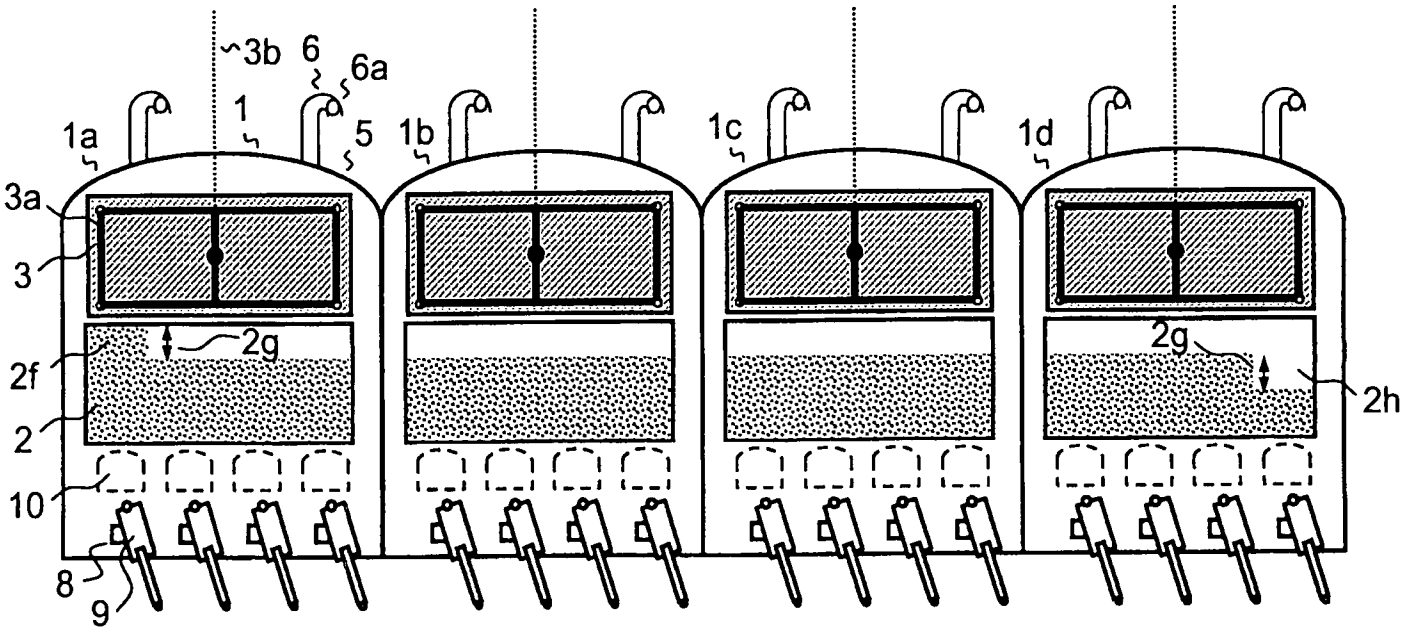
FIG. 3 shows a coke oven chamber battery according to an embodiment of the present invention.
Figure 4:
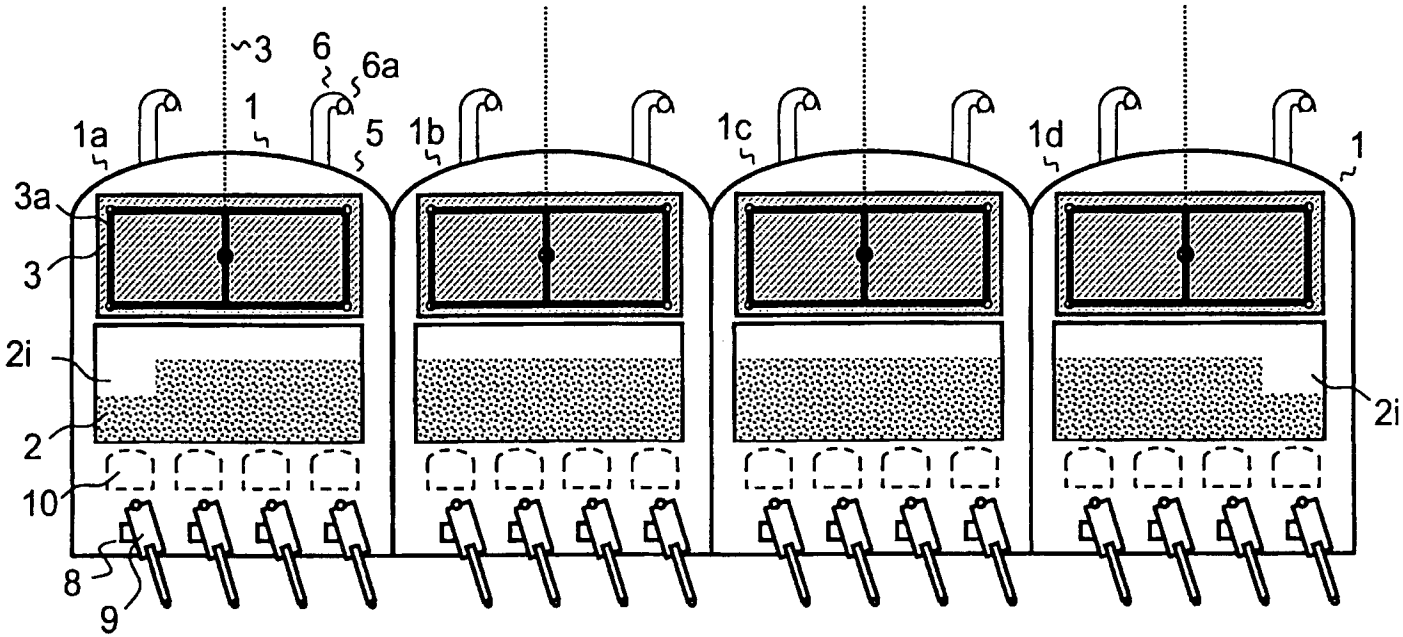
FIG. 4 shows a coke oven chamber battery according to an embodiment of the present invention.

FIG. 1 shows a coke oven chamber with the inventive recesses in the coal cake in the environment of the coke oven chamber doors. FIG. 2 shows a coke oven chamber with the inventive recesses of a reduced coal density in the coal cake in the environment of the coke oven chamber doors. FIG. 3 shows a coke oven bank comprised of four coke oven chambers, the first coke oven chamber of which is charged with a coal cake having the inventive recess and the last coke oven chamber of which is charged with a coal cake having the inventively increased coal density. FIG. 4 shows a coke oven bank comprised of four coke oven chambers, the first and last coke oven chambers of which are charged with an inventive coal cake having recesses of a reduced coal cake density.

FIG. 1 shows a coke oven chamber (1) charged with a coal cake (2) and provided with the gas space or primary heating space (2*a*) lying there above, said coal cake having the inventive recess (2*b*) not filled with coal and situated in the environment of the coke oven chamber door (3). It is 0.25 to 5 m deep (2*c*). To be seen here, too, are the coke oven chamber wall (4) above the coke oven chamber door (3), the carrying device (3*a*) fastened thereto including a moving mechanism (3*b*), the coke oven chamber top (5) with apertures (6) and devices (6*a*) regulating the air current, "downcomer" tubes (7) with apertures (7*a*) for passing through partially burnt coking gases into the secondary air soles (8), the secondary air soles (8) with the flue gas channels (9) situated there above in which partially burnt coking gas is completely burnt with secondary air, for heating the coal cake from below, and apertures (10) with control facilities through which the current of secondary air streaming in is regulated.

FIG. 2 shows a coke oven chamber (1) charged with a coal cake (2) and provided with the gas space or primary heating space (2*a*) lying there above, said coal cake having the inventive recess (2*d*) filled with a coal batch of less density and situated in the environment of the coke oven chamber door (3). It is 0.25 to 5 m deep (2*e*).

FIG. 3 shows a coke oven chamber battery comprised of 4 coke oven chambers (1*a-d*). The first coke oven chamber (1*a*) is charged with a coal cake (2) which has an elevation (2*f*) on the side facing the coke oven end chamber side. It is 20 to 700 mm high (2*g*). The last coke oven chamber (1*d*) is charged with a coal cake (2) which has a recess (2*h*) on the side facing the coke oven end chamber side. It is also 20 to 700 mm high (2*g*).

FIG. 4 shows a coke oven chamber battery comprised of 4 coke oven chambers (1*a-d*). The first and the last coke oven chamber (1*a*, 1*d*) are charged with a coal cake (2) which has a recess (2*i*) on the side facing the coke oven end chamber side. It is charged with a coal compact or a coal batch having a lower density of 20 to 300 kg/m$^3$.

LIST OF REFERENCE SYMBOLS

1 Coke oven chamber
1*a-d* Coke oven chamber of a coke oven bank or coke oven battery
2 Coal cake
2*a* Primary heating space
2*b* Recess
2*c* Depth of recess
2*d* Recess with lower coal cake density
2*e* Depth of recess with lower coal cake density
2*f* Elevation of coal cake
2*g* Height of recess or elevation
2*h* Recess of coal cake
2*i* Recess of coal cake with lower coal density
3 Coke oven chamber door
3*a* Carrying device or carrying frame of coke oven chamber door
3*b* Moving mechanism of coke oven chamber door
4 Coke oven chamber wall
5 Coke oven chamber top
6 Aperture through coke oven chamber top
6*a* Air current regulating devices
7 "Downcomer" tubes
7*a* Apertures of "downcomer" tubes
8 Secondary air sole
9 Secondary heating space
10 Apertures of secondary air sole

The invention claimed is:

1. A method of reducing heat radiation losses through coke oven chamber doors and end walls, comprising:

pressing a heap of coal by applying a compacting method to obtain a compacted coal cake having a density ranging from 700 to 1300 kg/m$^3$; and charging the compacted coal cake through the charging opening of a coke oven chamber into the coke oven chamber; wherein the height and/or density of the coal cake next to the coke oven chamber doors and end walls is modified by one of:

(a) generating a recess within the coal cake during coal compaction at the upper coal cake sides to be placed facing the coke oven chamber doors, by omitting an amount of coal in the coal cake, the recess being formed by:

(1) not filling the recess with coal;

(2) filling the recess with less coal; or (3) filling the recess with coal of a lower density compared to the density of the compacted coal cake in the coke oven chamber, or (b) generating an elevation within the coal cake during coal compaction at the upper coal cake sides to be placed facing the coke oven chamber doors, by adding an amount of coal to the coal cake.

2. The method of reducing heat radiation losses according to claim 1, wherein the height of the recess or elevation accounts for 20 to 700 mm and its depth reaching into the coke oven chamber accounts for 0.25 to 5 meters.

3. The method of reducing heat radiation losses according to claim 1, wherein the elevation is generated by adding coal into the coal cake and pressing-down the free space thus obtained or by placement of additional compacts on top.

4. The method of reducing heat radiation losses according to claim 1, wherein if the recess is to be filled with less coal or coal of a lower density, these steps comprise post-filling of the recess left empty in top charging mode or refilling including shaking, with the recess thus generated having a lower coal cake density.

5. The method of reducing heat radiation losses according to claim 4, wherein the recess with the lower coal cake density has a lower coal cake density of 20 to 300 kg/m$^3$.

6. The method of reducing heat radiation losses according to claim 1, wherein:

the coke oven chamber is part of a coke oven battery or coke oven bank, and the first coke oven chamber of the coke oven battery or coke oven bank is provided with an elevation of the coal cake along the laterally closing confining coke oven chamber end wall, and the last coke oven chamber of the coke oven battery or coke oven bank is provided with a recess of the coal cake along the laterally closing confining coke oven chamber end wall, and the recess or elevation is not exclusively generated at the coal cake sides facing the coke oven chamber doors.

7. The method of reducing heat radiation losses according to claim 6, wherein the elevation is generated by adding coal into the coal cake and pressing-down the free space thus obtained or by placement of additional compacts on top.

8. The method of reducing heat radiation losses according to claim 6, wherein the height of recess in the coal cake of the first coke oven chamber and the height of elevation in the coal cake of the last coke oven chamber of a coke oven battery accounts for 25 to 700 mm.

9. The method of reducing heat radiation losses according to claim 6, wherein the coke oven chamber is part of a coke oven battery or a coke oven bank, and that the first and last coke oven chamber of the coke oven battery or coke oven bank along the end wall are provided with a recess, and that these recesses are provided with a coal batch or a coal compact having a lower coal cake density.

10. The method of reducing heat radiation losses according to claim 9, wherein the recesses in the coal cake of the first and last coke oven chamber of the coke oven battery or coke oven bank have a lower coal cake density accounting for 20 to 300 kg/m$^3$.

* * * * *